US011802722B2

(12) United States Patent
Tanaka et al.

(10) Patent No.: US 11,802,722 B2
(45) Date of Patent: Oct. 31, 2023

(54) REFRIGERATION CYCLE APPARATUS

(71) Applicant: Mitsubishi Electric Corporation, Tokyo (JP)

(72) Inventors: Chitose Tanaka, Tokyo (JP); So Nomoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 401 days.

(21) Appl. No.: 17/256,746

(22) PCT Filed: Sep. 5, 2018

(86) PCT No.: PCT/JP2018/032899
§ 371 (c)(1),
(2) Date: Dec. 29, 2020

(87) PCT Pub. No.: WO2020/049660
PCT Pub. Date: Mar. 12, 2020

(65) Prior Publication Data

US 2021/0364201 A1 Nov. 25, 2021

(51) Int. Cl.
*F25B 43/00* (2006.01)
*F25B 49/02* (2006.01)

(52) U.S. Cl.
CPC ..... *F25B 43/006* (2013.01); *F25B 49/02* (2013.01); *F25B 2313/02323* (2013.01);
(Continued)

(58) Field of Classification Search
CPC .. F25B 2313/02323; F25B 2313/02741; F25B 2400/23; F25B 2500/26;
(Continued)

(56) References Cited

U.S. PATENT DOCUMENTS

2005/0188717 A1* 9/2005 Aikawa ..... F25D 16/00 62/239
2013/0025305 A1* 1/2013 Higashiiue ..... F25B 41/00 62/115
2013/0042640 A1* 2/2013 Higashiiue ..... F25B 41/00 29/890.035

FOREIGN PATENT DOCUMENTS

JP S63-104959 U 7/1988
JP 07-012414 A 1/1995
(Continued)

OTHER PUBLICATIONS

Extended European Search Report dated Aug. 6, 2021, issued in corresponding EP Patent Application No. 18932804.0.
(Continued)

*Primary Examiner* — Henry T Crenshaw
(74) *Attorney, Agent, or Firm* — POSZ LAW GROUP, PLC

(57) ABSTRACT

A refrigeration cycle apparatus includes: a first refrigerant route; and a second refrigerant route. In the first refrigerant route, refrigerant flows in order of a compressor, a first heat exchanger, a first pipe, a second heat exchanger, a low pressure receiver and the compressor. The second refrigerant route is connected to the first pipe and the low pressure receiver, the first pipe being connected to the first heat exchanger and the second heat exchanger in the first refrigerant route. The second refrigerant route includes an electric pump. The electric pump is configured to flow the refrigerant from the low pressure receiver to the first pipe.

7 Claims, 12 Drawing Sheets

(52) U.S. Cl.
CPC . *F25B 2313/02741* (2013.01); *F25B 2400/23* (2013.01); *F25B 2500/26* (2013.01); *F25B 2600/05* (2013.01); *F25B 2700/04* (2013.01)

(58) Field of Classification Search
CPC .. F25B 2600/05; F25B 2700/04; F25B 43/00; F25B 43/006; F25B 49/02
See application file for complete search history.

(56) References Cited

FOREIGN PATENT DOCUMENTS

| | | | | | |
|---|---|---|---|---|---|
| JP | 11-094374 | A | | 4/1999 | |
| JP | 2004-309029 | A | | 11/2004 | |
| JP | 2004309029 | A | * | 11/2004 | ..... F25B 13/00 |
| WO | 2012/105676 | A1 | | 8/2012 | |

OTHER PUBLICATIONS

International Search Report of the International Searching Authority dated Nov. 20, 2018 for the corresponding International application No. PCT/JP2018/032899 (and English translation).

* cited by examiner

REFRIGERATION CYCLE APPARATUS

CROSS REFERENCE TO RELATED APPLICATION

This application is a U.S. national stage application of International Application PCT/JP2018/032899 filed on Sep. 5, 2018, the contents of which are incorporated herein by reference.

TECHNICAL FIELD

The present invention relates to a refrigeration cycle apparatus.

BACKGROUND

A large amount of liquid refrigerant may accumulate in an accumulator, for example, at startup of a heating operation. For example, Japanese Utility-Model Laying-Open No. S63-104959 (PTL 1) describes, as a conventional accumulator for a refrigerator, an accumulator configured such that an outlet pipe inserted into the accumulator is provided with an oil return hole. In the conventional accumulator for a refrigerator, together with a compressor lubricating oil, liquid refrigerant is suctioned into a compressor through the outlet pipe, and thus, the liquid refrigerant is discharged from the accumulator.

PATENT LITERATURE

PTL 1: Japanese Utility-Model Laying-Open No. S63-104959

However, the conventional accumulator for a refrigerator described in the publication above has a problem of low discharge speed of the liquid refrigerant. The low discharge speed of the liquid refrigerant results in a shortage of the refrigerant in a condenser, and thus, a rise in pressure of the refrigerant in the condenser delays. As a result, arrival at a desired heating capacity delays.

SUMMARY

The present invention has been made in light of the above-described problem, and an object of the present invention is to provide a refrigeration cycle apparatus that can rapidly discharge liquid refrigerant accumulated in an accumulator (low pressure receiver).

A refrigeration cycle apparatus of the present invention includes: a first refrigerant route; and a second refrigerant route. In the first refrigerant route, refrigerant flows in order of a compressor, a first heat exchanger, a first pipe, a second heat exchanger, a low pressure receiver and the compressor. The second refrigerant route is connected to the first pipe and the low pressure receiver, the first pipe being connected to the first heat exchanger and the second heat exchanger in the first refrigerant route. The second refrigerant route includes an electric pump. The electric pump is configured to flow the refrigerant from the low pressure receiver to the first pipe.

According to the refrigeration cycle apparatus of the present invention, the electric pump included in the second refrigerant route is configured to flow the refrigerant from the low pressure receiver to the first pipe. Therefore, since the electric pump flows the refrigerant from the low pressure receiver to the first pipe, the liquid refrigerant accumulated in the low pressure receiver can be rapidly discharged.

DETAILED DESCRIPTION

Figure 1:
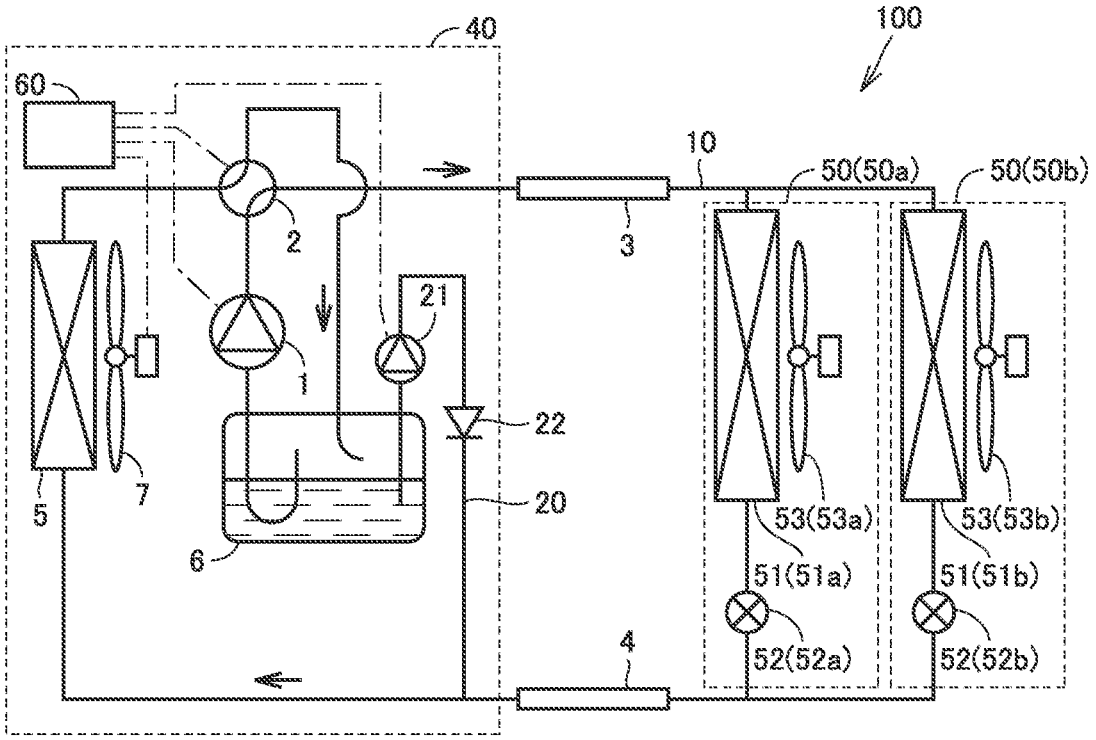
FIG. 1 is a refrigerant circuit diagram during a heating operation in a refrigeration cycle apparatus according to a first embodiment of the present invention.

Embodiments of the present invention will be described hereinafter with reference to the drawings. In the following description, the same or corresponding members and portions are denoted by the same reference characters, and redundant description will not be repeated. In addition, in the drawings described below, arrows indicating a flow of refrigerant are shown.

First Embodiment

A configuration of a refrigeration cycle apparatus 100 according to a first embodiment of the present invention will be described with reference to FIG. 1. Refrigeration cycle apparatus 100 according to the present embodiment is, for example, an air conditioner. FIG. 1 is a refrigerant circuit diagram of refrigeration cycle apparatus 100 according to the first embodiment of the present invention. In the present embodiment, refrigeration cycle apparatus 100 mainly includes an outdoor unit 40 and a plurality of indoor units 50. Outdoor unit 40 is placed outside, and the plurality of indoor units 50 are placed inside. Outdoor unit 40 and the plurality of indoor units 50 are connected by a gas-side connection pipe 3 and a liquid-side connection pipe 4.

Outdoor unit 40 mainly includes a compressor 1, a four-way valve 2, an outdoor heat exchanger 5, an accumulator 6, an outdoor blower 7, an electric pump 21, a check valve 22, and a controller 60.

Indoor unit 50 mainly includes an indoor heat exchanger 51, a decompressing apparatus 52 and an indoor blower 53. In the present embodiment, refrigeration cycle apparatus 100 includes two indoor units 50*a* and 50*b*. Indoor unit 50*a* includes an indoor heat exchanger 51*a*, a decompressing apparatus 52*a* and an indoor blower 53*a*. Indoor unit 50*b* includes an indoor heat exchanger 51*b*, a decompressing apparatus 52*b* and an indoor blower 53*b*.

Two indoor units 50*a* and 50*b* are connected in parallel with outdoor unit 40 in a refrigerant circuit. Although refrigeration cycle apparatus 100 includes two indoor units 50*a* and 50*b* in the present embodiment, refrigeration cycle apparatus 100 may include three or more indoor units 50. The number of indoor heat exchangers 51, the number of outdoor units 40, and the number of each element may be singular or plural.

A configuration of outdoor unit 40 in the present embodiment will be described in detail. Compressor 1 is configured to compress and discharge suctioned refrigerant. Compressor 1 may be configured such that a volume thereof is variable. In the present embodiment, compressor 1 is configured such that the volume thereof changes by adjusting a rotation speed of compressor 1 based on an instruction from controller 60.

Four-way valve 2 is configured to switch a flow of the refrigerant flowing through the refrigerant circuit between during a heating operation and during cooling and defrosting operations. In the present embodiment, four-way valve 2 is configured to switch between connecting the discharge side of compressor 1 to indoor heat exchangers 51*a* and 51*b* and connecting the discharge side of compressor 1 to outdoor heat exchanger 5 based on an instruction from controller 60.

Outdoor heat exchanger 5 performs heat exchange between the refrigerant and outdoor air. Outdoor heat exchanger 5 is composed of, for example, a pipe and a fin. Outdoor heat exchanger 5 functions as an evaporator that evaporates the refrigerant during the heating operation, and functions as a condenser that condenses the refrigerant during the cooling operation and during the defrosting operation.

Outdoor blower 7 is provided adjacent to outdoor heat exchanger 5. Outdoor blower 7 is configured to supply air flowing around outdoor heat exchanger 5. In the present embodiment, outdoor blower 7 is configured such that an amount of air flowing around outdoor heat exchanger 5 is adjusted and an amount of heat exchange between the air and the refrigerant is adjusted by adjusting a rotation speed of outdoor blower 7 based on an instruction from controller 60.

Accumulator 6 is a container that can accumulate the refrigerant therein. Accumulator 6 is connected to the suction side of compressor 1. In accumulator 6, the refrigerant is subjected to gas-liquid separation. Accumulator 6 is arranged on the outlet side of an evaporator. That is, accumulator 6 is arranged on the low pressure side in the refrigerant circuit.

Electric pump 21 is an electrically-driven pump. Electric pump 21 is configured to operate in accordance with a voltage applied to electric pump 21. In the present embodiment, electric pump 21 is configured such that an amount of discharge of electric pump 21 is adjusted by adjusting the voltage applied to electric pump 21 based on an instruction from controller 60.

Check valve 22 is connected to electric pump 21 and liquid-side connection pipe 4. Check valve 22 is configured to flow the refrigerant from electric pump 21 to liquid-side connection pipe 4 and not to flow the refrigerant from liquid-side connection pipe 4 to electric pump 21.

Controller 60 is configured to control the instruments, the apparatuses and the like of refrigeration cycle apparatus 100 by calculations, instructions and the like. Particularly, controller 60 is electrically connected to compressor 1, four-way valve 2, outdoor blower 7, electric pump 21, decompressing apparatuses 52*a* and 52*b*, and indoor blowers 53*a* and 53*b*, and is configured to control operations of these apparatuses. In FIG. 1 and the like, for ease of illustration, electrical connection between controller 60 and the apparatuses in outdoor unit 40 is indicated by an alternate long and short dash line. However, electrical connection between controller 60 and the apparatuses in indoor unit 50 is not shown.

A configuration of indoor unit 50 in the present embodiment will be described in detail. Indoor heat exchangers 51*a* and 51*b* perform heat exchange between the refrigerant and indoor air. Each of indoor heat exchangers 51*a* and 51*b* is composed of, for example, a pipe and a fin. Each of indoor heat exchangers 51*a* and 51*b* functions as a condenser that condenses the refrigerant during the heating operation, and functions as an evaporator that evaporates the refrigerant during the cooling operation and during the defrosting operation. Decompressing apparatuses 52*a* and 52*b* are configured to expand and decompress the refrigerant condensed by a condenser. In the present embodiment, decompressing apparatuses 52*a* and 52*b* are electronic control valves.

Indoor blowers 53*a* and 53*b* are provided adjacent to indoor heat exchangers 51*a* and 51*b*, respectively. In the present embodiment, indoor blowers 53*a* and 53*b* are configured such that an amount of air flowing around indoor heat exchangers 51*a* and 51*b* is adjusted and an amount of heat exchange between the air and the refrigerant is adjusted by adjusting rotation speeds of indoor blowers 53*a* and 53*b* based on an instruction from controller 60.

Figure 2:
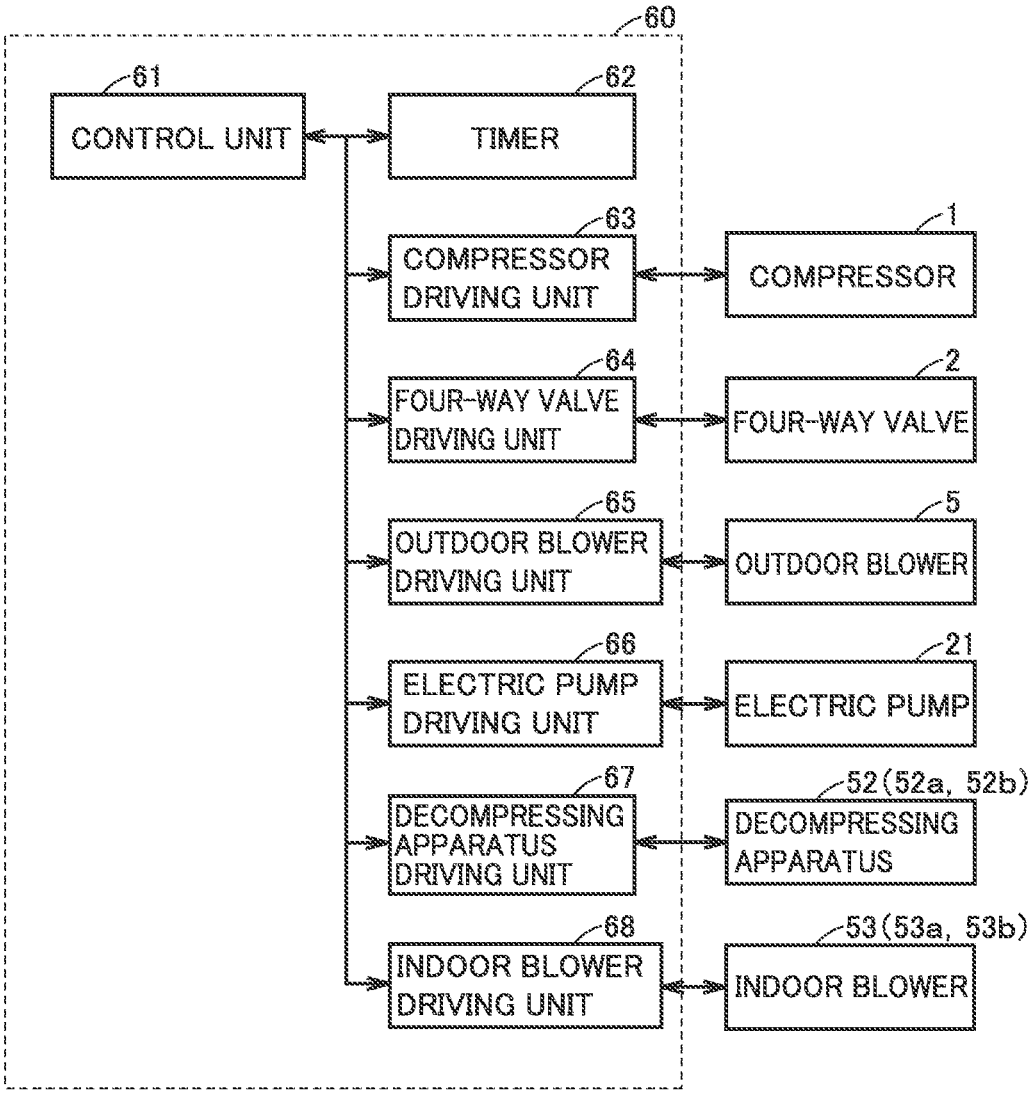
FIG. 2 is a functional block diagram of the refrigeration cycle apparatus according to the first embodiment of the present invention.

Controller 60 will be described in detail with reference to FIGS. 1 and 2. Controller 60 mainly includes a control unit 61, a timer 62, a compressor driving unit 63, a four-way valve driving unit 64, an outdoor blower driving unit 65, an electric pump driving unit 66, a decompressing apparatus driving unit 67, and an indoor blower driving unit 68.

Control unit 61 controls compressor driving unit 63, four-way valve driving unit 64, outdoor blower driving unit 65, electric pump driving unit 66, decompressing apparatus driving unit 67, indoor blower driving unit 68 and the like, based on signals from timer 62, a pressure measuring apparatus and a temperature measuring apparatus (both are not shown), and the like.

Timer 62 measures a time period and transmits a signal based on the time period to control unit 61. The pressure measuring apparatus (not shown) is attached to the refrigerant circuit, and measures a pressure of the refrigerant and transmits a signal based on the pressure to control unit 61. The temperature measuring apparatus (not shown) is attached to the refrigerant circuit, and measures a temperature of the refrigerant and the air and transmits a signal based on the temperature to control unit 61.

Compressor driving unit 63 drives compressor 1 based on an instruction from control unit 61. Specifically, compressor driving unit 63 controls a rotation speed of a motor (not shown) of compressor 1 by controlling a frequency of an alternating current flowing through the motor of compressor 1.

Four-way valve driving unit 64 drives four-way valve 2 based on an instruction from control unit 61. Specifically, four-way valve driving unit 64 controls switching of four-way valve 2 by controlling a driving source such as a motor (not shown) attached to four-way valve 2.

Outdoor blower driving unit 65 drives outdoor blower 7 based on an instruction from control unit 61. Specifically, outdoor blower driving unit 65 controls the rotation speed of outdoor blower 7 by controlling a driving source such as a motor (not shown) attached to outdoor blower 7.

Electric pump driving unit 66 drives electric pump 21 based on an instruction from control unit 61. Specifically, electric pump driving unit 66 controls the amount of discharge by controlling a voltage flowing through a motor (not shown) of electric pump 21. Decompressing apparatus driving unit 67 drives decompressing apparatuses 52*a* and 52*b* based on an instruction from control unit 61. Specifically, decompressing apparatus driving unit 67 controls a degree of opening of decompressing apparatuses 52*a* and 52*b* by controlling driving sources such as motors (not shown) attached to decompressing apparatuses 52*a* and 52*b*.

Indoor blower driving unit 68 drives indoor blowers 53*a* and 53*b* based on an instruction from control unit 61. Specifically, indoor blower driving unit 68 controls the rotation speeds of indoor blowers 53*a* and 53*b* by controlling driving sources such as motors (not shown) attached to indoor blowers 53*a* and 53*b*.

The refrigerant circuit diagram shown in FIG. 1 shows the refrigerant circuit during the heating operation. Refrigeration cycle apparatus 100 includes a first refrigerant route 10 and a second refrigerant route 20. In first refrigerant route 10, the refrigerant flows in order of compressor 1, indoor heat exchanger (first heat exchanger) 51, liquid-side connection pipe (first pipe) 4, outdoor heat exchanger (second heat exchanger) 5, accumulator (low pressure receiver) 6, and compressor 1.

In the present embodiment, first refrigerant route 10 includes compressor 1, four-way valve 2, gas-side connection pipe 3, indoor heat exchangers 51*a* and 51*b*, decompressing apparatuses 52*a* and 52*b*, liquid-side connection pipe 4, outdoor heat exchanger 5, and accumulator 6. The refrigerant flows through compressor 1, four-way valve 2, gas-side connection pipe 3, indoor heat exchangers 51*a* and 51*b*, decompressing apparatuses 52*a* and 52*b*, liquid-side connection pipe 4, outdoor heat exchanger 5, and four-way valve 2, and then, flows through accumulator 6 to compressor 1.

In addition to first refrigerant route 10 described above, refrigeration cycle apparatus 100 shown in FIG. 1 includes second refrigerant route 20 for discharging liquid refrigerant from inside accumulator 6. Second refrigerant route 20 is connected to liquid-side connection pipe 4 and accumulator 6. Liquid-side connection pipe 4 is connected to indoor heat exchanger 51 and outdoor heat exchanger 5 in first refrigerant route 10. Second refrigerant route 20 includes electric pump 21 and check valve 22. Second refrigerant route 20 extends from inside accumulator 6 through electric pump 21 and check valve 22 to liquid-side connection pipe 4 and is connected to liquid-side connection pipe 4.

Electric pump 21 is configured to flow the refrigerant from accumulator 6 to liquid-side connection pipe 4. In the present embodiment, electric pump 21 is arranged outside accumulator 6. Electric pump 21 may be located inside or outside accumulator 6. That is, electric pump 21 may be arranged inside accumulator 6, or may be arranged outside accumulator 6. Check valve 22 may be arranged upstream of electric pump 21 in second refrigerant route 20, or may be arranged downstream of electric pump 21 in second refrigerant route 20. When electric pump 21 has the function of blocking a reverse direction flow, refrigeration cycle apparatus 100 does not necessarily need to include check valve 22.

Figure 3:
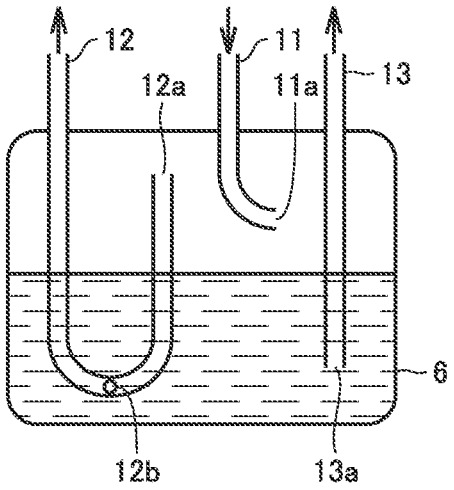
FIG. 3 is a schematic cross-sectional view of an accumulator according to the first embodiment of the present invention.

A configuration of accumulator 6 will be described in more detail with reference to FIG. 3. FIG. 3 is a schematic view showing an internal structure of accumulator 6. Accumulator 6 generally has a cylindrical shape. As shown in FIG. 3, accumulator 6 is a horizontal cylindrical accumulator in the present embodiment. Accumulator 6 may be a vertical cylindrical accumulator.

First refrigerant route 10 includes an inflow pipe 11 and an outflow pipe 12. Second refrigerant route 20 includes a liquid draining pipe 13. Inflow pipe 11 and outflow pipe 12 of first refrigerant route 10 and liquid draining pipe 13 of second refrigerant route 20 are connected to accumulator 6. Inflow pipe 11, outflow pipe 12 and liquid draining pipe 13 are inserted into accumulator 6 from outside accumulator 6.

Inflow pipe 11 is connected to four-way valve 2. Inflow pipe 11 includes a flow inlet 11*a*. Flow inlet 11*a* is located in accumulator 6. Flow inlet 11*a* is configured to flow the refrigerant into accumulator 6. The refrigerant flowing from four-way valve 2 to inflow pipe 11 flows into accumulator 6 through flow inlet 11*a*.

Flow inlet 11*a* of inflow pipe 11 is oriented in a direction that is parallel to a liquid level of the refrigerant accumulated in accumulator 6. This reduces or prevents a phenomenon in which the refrigerant flowing into accumulator 6 through flow inlet 11*a* of inflow pipe 11 directly comes into collision with the liquid level of the refrigerant accumulated in accumulator 6, which causes disturbance of the liquid level of the refrigerant and generation of droplets of the liquid refrigerant. Therefore, the gas-liquid separation effect of accumulator 6 is not impaired.

Outflow pipe 12 is connected to a suction port of compressor 1. Outflow pipe 12 includes a flow outlet 12*a*. Flow outlet (first refrigerant route flow outlet) 12*a* is located in accumulator 6. Flow outlet 12*a* is configured to allow the refrigerant to flow out of accumulator 6 to compressor 1. The refrigerant flowing from accumulator 6 to outflow pipe 12 is suctioned from the suction side of compressor 1.

Outflow pipe 12 is formed in the U shape. Due to this shape, outflow pipe 12 is sometimes called "U-shaped pipe". Flow outlet 12*a* is provided at a tip of outflow pipe 12 located in accumulator 6. Flow outlet 12*a* of outflow pipe 12 is oriented upward in accumulator 6.

Refrigeration cycle apparatus 100 is controlled based on an instruction from controller 60 such that the liquid level of the refrigerant accumulated in accumulator 6 becomes lower than flow outlet 12*a* of outflow pipe 12. Therefore, flow outlet 12*a* generally suctions only vapor refrigerant. Not only the refrigerant but also a part of a lubricating oil for lubricating the compressor flows out of compressor 1 and circulates through the refrigerant circuit together with the refrigerant. An amount of the lubricating oil circulating through the refrigerant circuit is small. The lubricating oil, which is constantly a liquid, is subjected to gas-liquid separation in accumulator 6 and is accumulated in a lower part in accumulator 6. Excessive accumulation of the lubricating oil in accumulator 6 results in a shortage of the lubricating oil in compressor 1. Therefore, a bearing and the like of compressor 1 are damaged due to poor lubrication, and thus, compressor 1 fails.

Outflow pipe 12 includes an oil return hole 12*b*. Oil return hole 12*b* is located in accumulator 6. Oil return hole 12*b* is configured to return the lubricating oil of compressor 1 from accumulator 6 to compressor 1.

Generally, at least one oil return hole 12*b* is provided in outflow pipe 12. At least one of oil return holes 12*b* is provided near a lowermost part of outflow pipe 12 bent into a U shape. That is, oil return hole 12*b* is provided in a curved portion that connects straight portions of outflow pipe 12. Oil return hole 12*b* has a diameter of about several millimeters. During operation of compressor 1, the vapor refrigerant is suctioned through flow outlet 12*a* of outflow pipe 12, and at the same time, a mixture of the liquid refrigerant accumulated in accumulator 6 and the lubricating oil is suctioned through oil return hole 12*b*.

When a dimension (size) of oil return hole 12*b* is increased, a larger amount of the lubricating oil can be returned to compressor 1. At the same time, however, a larger amount of the liquid refrigerant is also supplied to compressor 1. The liquid refrigerant dilutes the lubricating oil to thereby reduce a viscosity of the lubricating oil, which may cause poor lubrication of compressor 1. As described above, the dimension of oil return hole 12*b*, whether it is too large or too small, leads to a failure of compressor 1. Therefore, it is necessary to design oil return hole 12*b* to have an appropriate dimension.

Liquid draining pipe 13 is connected to electric pump 21. Liquid draining pipe 13 includes a flow outlet 13*a*. Flow outlet (second refrigerant route flow outlet) 13*a* is located in accumulator 6. Flow outlet 13*a* is configured to allow the refrigerant to flow out of accumulator 6 to liquid-side connection pipe 4. Flow outlet 13*a* is arranged above oil return hole 12*b*. Flow outlet 13*a* of liquid draining pipe 13 is oriented downward in accumulator 6.

Liquid draining pipe 13 is desirably inserted to reach a region near a lower end in accumulator 6 in order to discharge the liquid refrigerant accumulated in a bottom part of accumulator 6. On the other hand, unless flow outlet 13*a* provided at a lower end of liquid draining pipe 13 is provided at a position higher than at least one oil return hole 12*b*, oil return to compressor 1 through oil return hole 12*b* is impossible. Therefore, flow outlet 13*a* of liquid draining pipe 13 is arranged above oil return hole 12*b* arranged in the lowermost part.

When electric pump 21 is operated, the mixture of the liquid refrigerant and the lubricating oil accumulated in the bottom part of accumulator 6 flows through second refrigerant route 20 to liquid-side connection pipe 4. On the refrigerant circuit, accumulator 6 is closer to the suction port of compressor 1 than liquid-side connection pipe 4. That is, liquid-side connection pipe 4 is arranged on the upstream side in the refrigerant circuit, as compared with accumulator 6. Therefore, during operation of compressor 1, a refrigerant pressure is higher in liquid-side connection pipe 4 than in accumulator 6. Since electric pump 21 is not always operated, second refrigerant route 20 includes check valve 22 in order to prevent backflow of the refrigerant in second refrigerant route 20.

Next, each operation of refrigeration cycle apparatus 100 in the present embodiment will be described.

First, the cooling operation of refrigeration cycle apparatus 100 will be described with reference to FIG. 4.

The high-temperature and high-pressure vapor refrigerant compressed in compressor 1 flows through four-way valve 2 to outdoor heat exchanger 5, where the high-temperature and high-pressure vapor refrigerant dissipates heat to the outdoor air and condenses into high-pressure liquid refrigerant. The high-pressure liquid refrigerant flows through liquid-side connection pipe 4 to decompressing apparatuses 52*a* and 52*b*, where the high-pressure liquid refrigerant expands and is decompressed into low-temperature and low-pressure gas-liquid two-phase refrigerant.

The low-temperature and low-pressure gas-liquid two-phase refrigerant flows to indoor heat exchangers 51*a* and 51*b*, where the low-temperature and low-pressure gas-liquid two-phase refrigerant absorbs heat from the indoor air and evaporates into low-pressure vapor refrigerant. The low-pressure vapor refrigerant flows through gas-side connection pipe 3, four-way valve 2 and accumulator 6 back to compressor 1, where the low-pressure vapor refrigerant is compressed. The refrigerant circulates through the refrigerant circuit as described above.

Next, the heating operation of refrigeration cycle apparatus 100 will be described with reference to FIG. 1.

The high-temperature and high-pressure vapor refrigerant compressed in compressor 1 flows through four-way valve 2 and gas-side connection pipe 3 to indoor heat exchangers 51*a* and 51*b*, where the high-temperature and high-pressure vapor refrigerant dissipates heat to the indoor air and condenses into high-pressure liquid refrigerant. The high-pressure liquid refrigerant flows to decompressing apparatuses 52*a* and 52*b*, where the high-pressure liquid refrigerant expands and is decompressed into low-temperature and low-pressure gas-liquid two-phase refrigerant.

The low-temperature and low-pressure gas-liquid two-phase refrigerant flows through liquid-side connection pipe 4 to outdoor heat exchanger 5, where the low-temperature and low-pressure gas-liquid two-phase refrigerant absorbs heat from the outdoor air and evaporates into low-pressure vapor refrigerant. The low-pressure vapor refrigerant flows through four-way valve 2 and accumulator 6 back to compressor 1, where the low-pressure vapor refrigerant is compressed. The refrigerant circulates through the refrigerant circuit as described above.

When an outdoor air temperature is low (e.g., less than 7° C.) during the heating operation, a temperature of outdoor heat exchanger 5 falls below 0° C., and thus, water vapors in the outdoor air are cooled into frost by outdoor heat exchanger 5 and the frost adheres to outdoor heat exchanger 5. As the heating operation continues, the frost increases and blocks an air path of outdoor heat exchanger 5. The blocking of the air path of outdoor heat exchanger 5 by the frost causes a reduction in heat exchange performance and an increase in motive power of outdoor blower 7. Therefore, during the heating operation, the defrosting operation for melting the frost on outdoor heat exchanger 5 needs to be performed periodically (e.g., once per several tens of minutes).

Next, the defrosting operation will be described in detail. When a pipe temperature and the refrigerant pressure measured in outdoor heat exchanger 5 become equal to or less than a certain value during the heating operation, when the motive power of outdoor blower 7 becomes equal to or more than a certain vale during the heating operation, or when the heating operation continues for a certain time period or longer, controller (microcomputer) 60 determines that an amount of frost formed on outdoor heat exchanger 5 is large. Based on this determination by controller 60, the defrosting operation is performed in refrigeration cycle apparatus 100.

Figure 4:
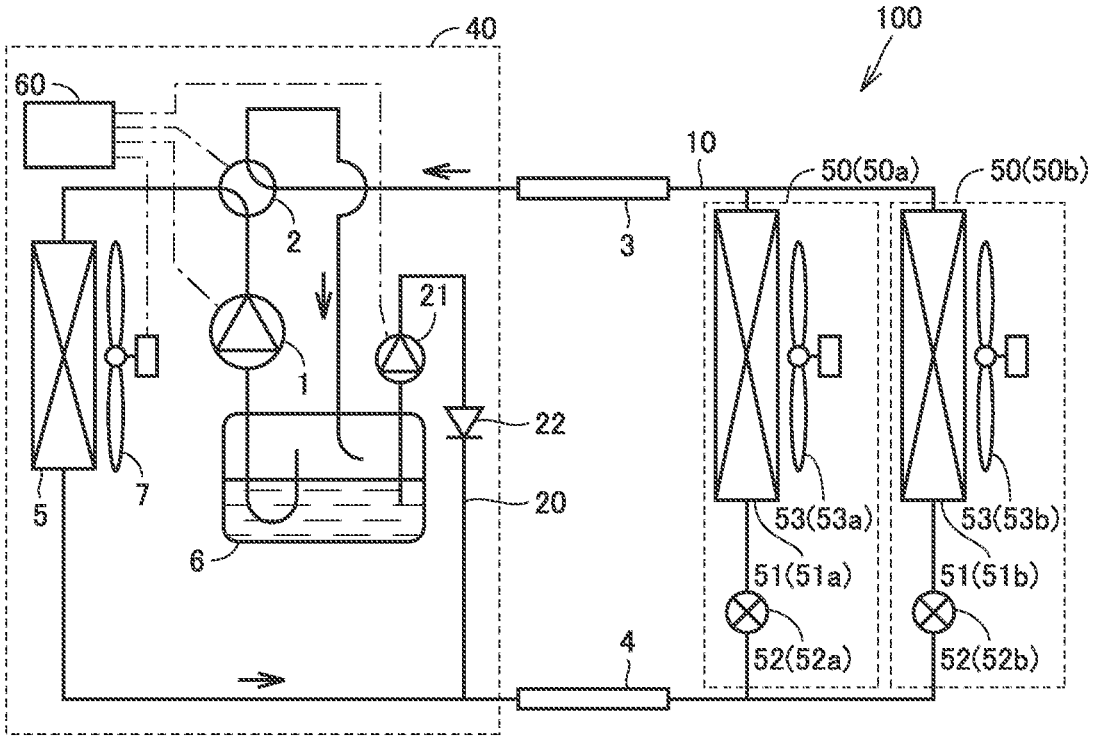
FIG. 4 is a refrigerant circuit diagram during a cooling operation in the refrigeration cycle apparatus according to the first embodiment of the present invention.

Switching from the heating operation to the defrosting operation is performed by switching four-way valve 2 from a position for the heating operation (FIG. 1) to a position for the cooling operation (FIG. 4). A flow direction of the refrigerant, a gas-liquid phase change and a heat transfer manner during the defrosting operation are the same as those during the cooling operation. By supplying the high-temperature and high-pressure vapor refrigerant to outdoor heat exchanger 5, the frost adhering to outdoor heat exchanger 5 can be melted. During the defrosting operation, outdoor blower 7 is desirably stopped in order to prevent an amount of heat of outdoor heat exchanger 5 from escaping to the outdoor air.

In addition, the low-temperature and low-pressure gas-liquid two-phase refrigerant flows through indoor heat exchangers 51*a* and 51*b*. During the defrosting operation, indoor blowers 53*a* and 53*b* are desirably stopped in order to prevent cold air from blowing into an indoor space.

When the pipe temperature and the refrigerant pressure measured in outdoor heat exchanger 5 become equal to or more than the certain value during the defrosting operation, or when the defrosting operation continues for a certain time period or longer, controller (microcomputer) 60 determines that defrosting of outdoor heat exchanger 5 has been completed. Based on this determination by controller 60, four-way valve 2 is switched to the heating position and the heating operation is restarted in refrigeration cycle apparatus 100.

Since outdoor heat exchanger 5 functions as a condenser during the defrosting operation, a large amount of the condensed liquid refrigerant is present in outdoor heat exchanger 5. When four-way valve 2 is switched to the heating position at the start of the heating operation, the flow direction of the refrigerant in outdoor heat exchanger 5 is reversed and the liquid refrigerant in outdoor heat exchanger 5 flows through four-way valve 2 into accumulator 6 and accumulates in the lower part of accumulator 6.

It takes time to allow the liquid refrigerant accumulated in accumulator 6 to flow out only through oil return hole 12*b*. In the meantime, a shortage of the liquid refrigerant causes a delay in pressure rise in indoor heat exchangers 51*a* and 51*b*, and thus, provision of the heating capacity delays. Therefore, arrival at the desired heating capacity delays. In the present embodiment, by operating electric pump 21 at this time, it is possible to allow the liquid refrigerant accumulated in accumulator 6 to flow to liquid-side connection pipe 4 through second refrigerant route 20.

The liquid refrigerant flowing from second refrigerant route 20 joins, in liquid-side connection pipe 4, with the low-pressure gas-liquid two-phase refrigerant flowing through decompressing apparatuses 52*a* and 52*b*, and flows into outdoor heat exchanger 5. The gas-liquid two-phase refrigerant absorbs heat from the outdoor air and evaporates into low-pressure vapor refrigerant in outdoor heat exchanger 5, and the low-pressure vapor refrigerant flows through the refrigerant circuit. Therefore, provision of the heating capacity can be made earlier.

In the present embodiment, electric pump 21 is driven when the heating operation during which the refrigerant flows from compressor 1 to indoor heat exchanger 51 starts after the defrosting operation during which the refrigerant flows from compressor 1 to outdoor heat exchanger 5 ends. Discharge of the liquid refrigerant in accumulator 6 by electric pump 21 can make earlier provision of the heating capacity at the time of return to the heating operation from the end of the defrosting operation.

In addition, provision of the heating capacity can also be made earlier at startup of the heating operation of refrigeration cycle apparatus 100 that is in a non-operation state during wintertime. In the present embodiment, electric pump 21 is driven at startup of compressor 1, and is stopped after the refrigerant is flown from accumulator 6 to liquid-side connection pipe 4 by electric pump 21. While refrigeration cycle apparatus 100 is in a non-operation state, the refrigerant in the refrigerant circuit liquefies and condenses and accumulates in a low-temperature portion. Therefore, particularly when refrigeration cycle apparatus 100 is in a non-operation state for a long time during wintertime, the liquid refrigerant accumulates in outdoor heat exchanger 5 exposed to the outdoor air. The liquid refrigerant flows into and accumulates in accumulator 6 at the start of the heating operation. Therefore, electric pump 21 is preferably operated at the start of the heating operation after refrigeration cycle apparatus 100 is in a non-operation state for a long time.

Next, a function and an effect of refrigeration cycle apparatus 100 in the present embodiment will be described.

According to refrigeration cycle apparatus 100 in the present embodiment, electric pump 21 included in second refrigerant route 20 is configured to flow the refrigerant from accumulator 6 to liquid-side connection pipe 4. Therefore, since electric pump 21 flows the refrigerant from accumulator 6 to liquid-side connection pipe 4, the liquid refrigerant accumulated in accumulator 6 can be rapidly discharged.

Electric pump 21 is configured such that the amount of discharge of the liquid refrigerant can be freely adjusted simply by applying the voltage to electric pump 21, and thus, the liquid refrigerant can be rapidly discharged immediately after startup of refrigeration cycle apparatus 100. Therefore, a rapid start after startup of refrigeration cycle apparatus 100 can be implemented. Thus, a sufficient amount of liquid discharge is obtained immediately after startup of refrigeration cycle apparatus 100.

In addition, electric pump 21 is configured such that the amount of discharge of the liquid refrigerant can be freely adjusted by adjusting the voltage applied to electric pump 21. Therefore, the liquid refrigerant in accumulator 6 can be actively discharged.

According to refrigeration cycle apparatus 100 in the present embodiment, flow outlet 13*a* of liquid draining pipe 13 is arranged above oil return hole 12*b*. Therefore, oil return to compressor 1 through oil return hole 12*b* is possible.

According to refrigeration cycle apparatus 100 in the present embodiment, electric pump 21 is driven at startup of compressor 1, and is stopped after the refrigerant is flown from accumulator 6 to liquid-side connection pipe 4 by electric pump 21. Since the refrigerant is likely to accumulate in accumulator 6 when compressor 1 is in a non-operation state, electric pump 21 is used to discharge the liquid refrigerant at startup of compressor 1, and thus, provision of the heating capacity in an early stage can be implemented. In addition, since electric pump 21 is stopped after the liquid refrigerant is discharged from accumulator 6 after startup of compressor 1, an increase in motive power of electric pump 21 can be suppressed.

According to refrigeration cycle apparatus 100 in the present embodiment, electric pump 21 is driven when the heating operation starts after the defrosting operation ends. Therefore, provision of the heating capacity in an early stage can be implemented at the start of the heating operation after the end of the defrosting operation.

Second Embodiment

Figure 5:
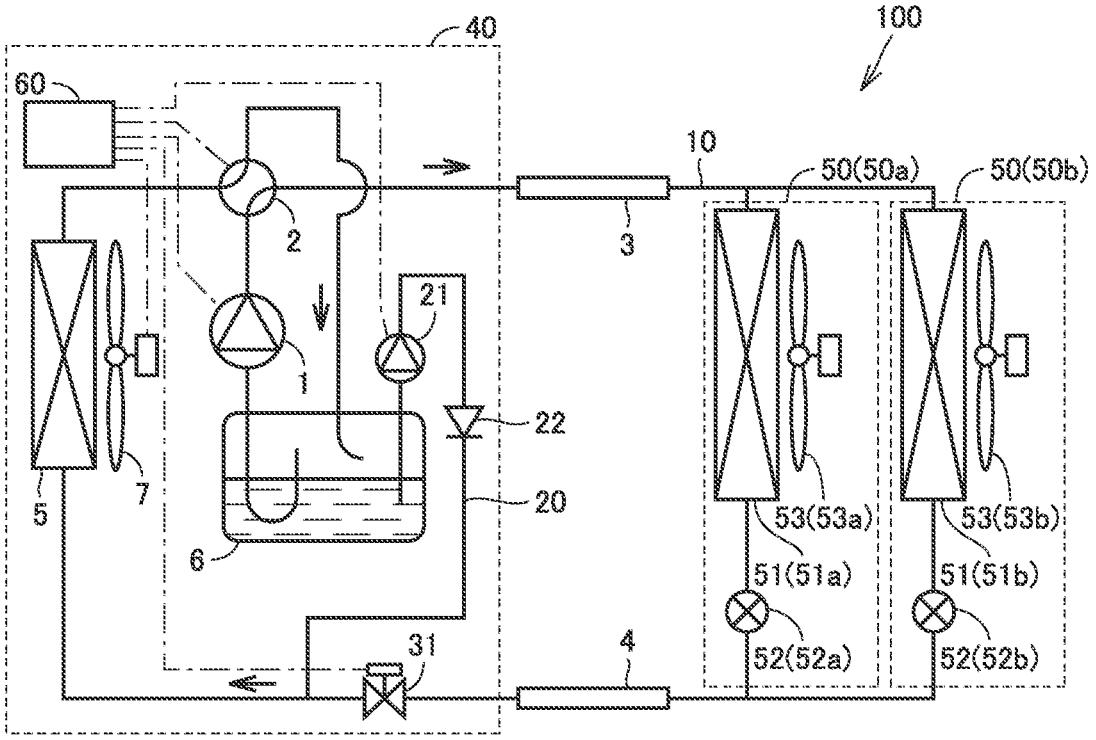
FIG. 5 is a refrigerant circuit diagram during a heating operation in a refrigeration cycle apparatus according to a second embodiment of the present invention.
Figure 6:
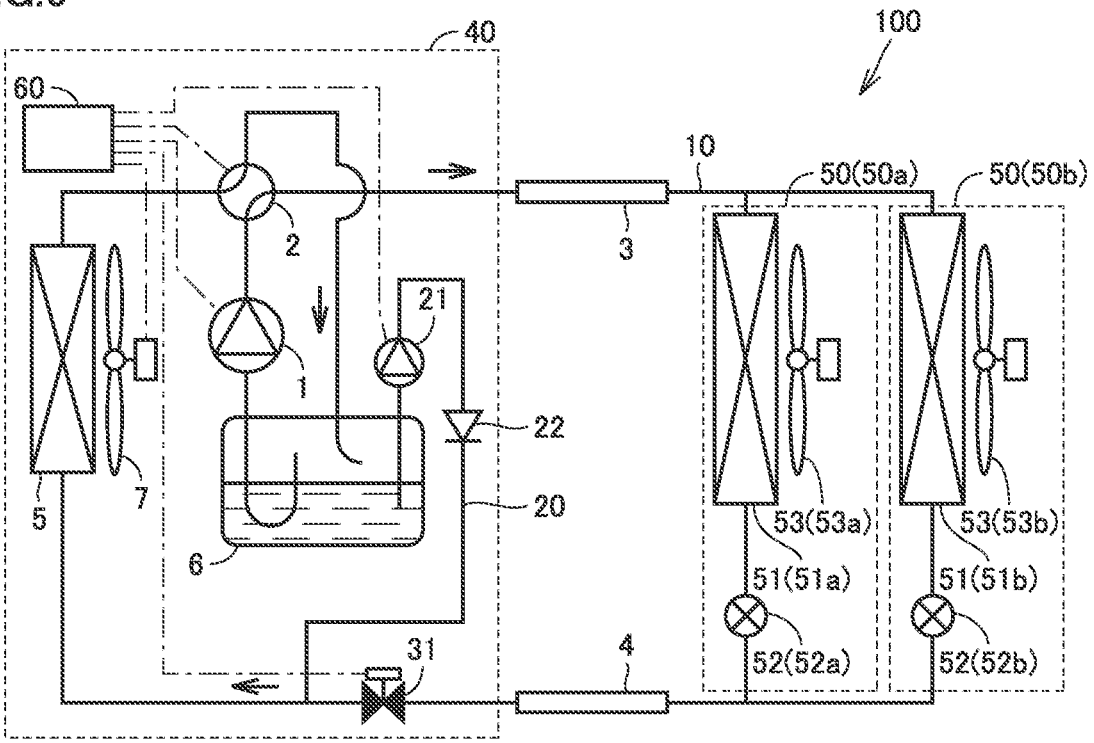
FIG. 6 is a refrigerant circuit diagram showing a state in which an on-off valve in the refrigeration cycle apparatus according to the second embodiment of the present invention is closed.

Referring to FIGS. 5 and 6, refrigeration cycle apparatus 100 according to a second embodiment of the present invention is different from refrigeration cycle apparatus 100 according to the first embodiment of the present invention in that an on-off valve 31 is provided in first refrigerant route 10. In FIG. 6, on-off valve 31 is filled with a black color in order to show a state in which on-off valve 31 is closed.

In refrigeration cycle apparatus 100 in the present embodiment, first refrigerant route 10 includes on-off valve 31. On-off valve 31 is configured to open and close first refrigerant route 10 between indoor heat exchanger 51 and outdoor heat exchanger 5 in first refrigerant route 10. On-off valve 31 is, for example, a solenoid valve. Second refrigerant route 20 is connected to liquid-side connection pipe 4 between on-off valve 31 and outdoor heat exchanger 5.

Figure 7:
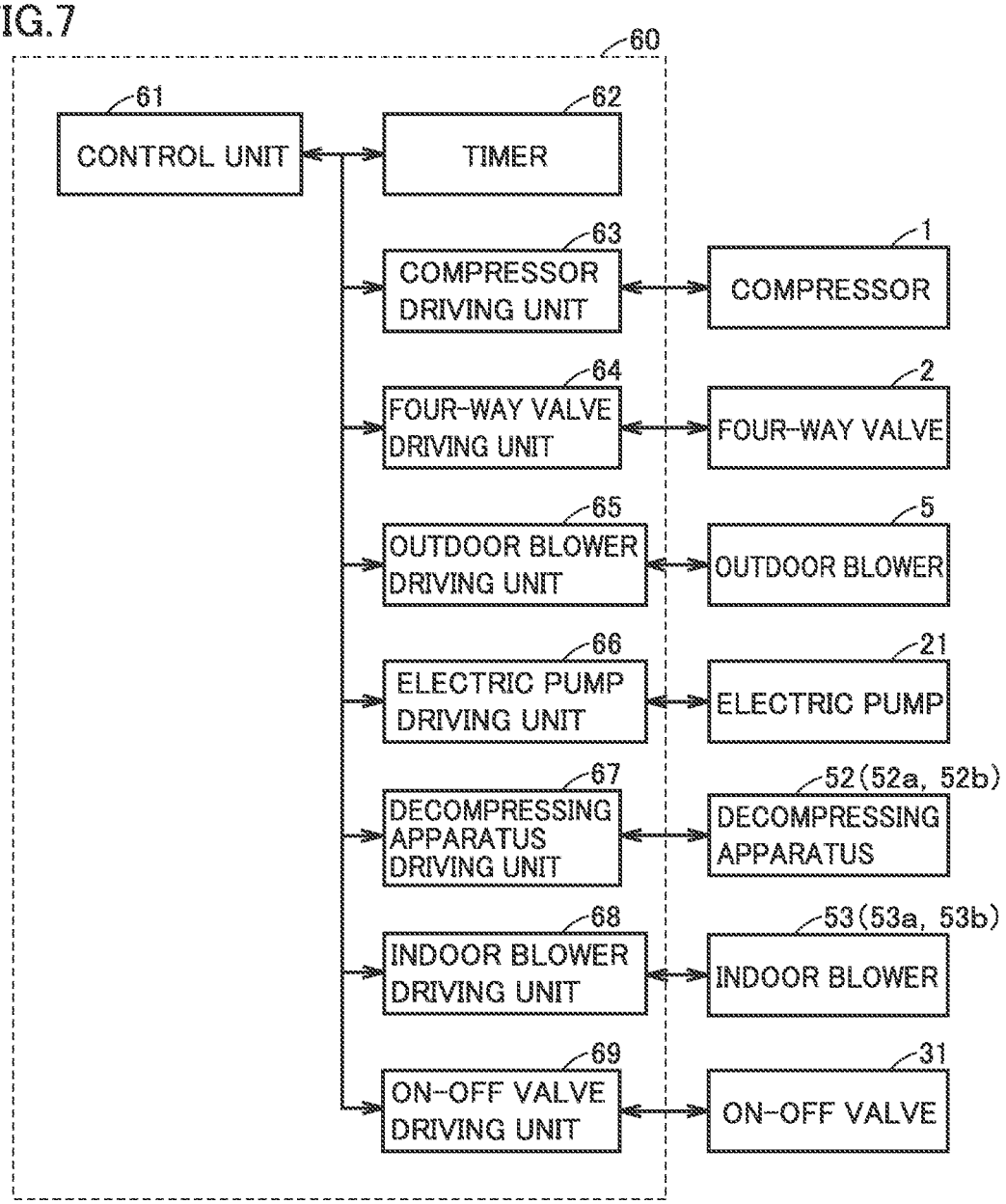
FIG. 7 is a functional block diagram of the refrigeration cycle apparatus according to the second embodiment of the present invention.

Referring to FIG. 7, in the present embodiment, controller 60 includes an on-off valve driving unit 69. On-off valve driving unit 69 drives on-off valve 31 based on an instruction from control unit 61. Specifically, on-off valve driving unit 69 controls opening and closing of on-off valve 31 by controlling a driving source such as a motor (not shown) attached to on-off valve 31.

Referring to FIG. 6, in refrigeration cycle apparatus 100, electric pump 21 is driven in a state where on-off valve 31 closes first refrigerant route 10 at startup of compressor 1. Referring to FIG. 5, after the refrigerant is flown from accumulator 6 to liquid-side connection pipe 4 by electric pump 21, on-off valve 31 opens first refrigerant route 10.

When on-off valve 31 is closed and electric pump 21 is operated at the start of the heating operation, accumulation of the liquid refrigerant in indoor heat exchangers 51*a* and 51*b* and discharge of the liquid refrigerant in accumulator 6 can be promoted, and thus, provision of the heating capacity can be made much earlier.

By closing on-off valve 31, the liquid refrigerant condensed in indoor heat exchangers 51*a* and 51*b* does not return to compressor 1. The liquid refrigerant discharged from accumulator 6 by electric pump 21 is subjected to heat exchange with the outdoor air and evaporates in outdoor heat exchanger 5, and is supplied to indoor unit 50 through compressor 1. Therefore, the refrigerant in accumulator 6 is discharged immediately.

When on-off valve 31 is opened, the liquid refrigerant accumulated in indoor heat exchangers 51*a* and 51*b* and liquid-side connection pipe 4 returns to compressor 1. Therefore, the degree of opening of decompressing apparatuses 52*a* and 52*b* is adjusted such that an amount of the liquid refrigerant supplied to outdoor heat exchanger 5 does not excessively exceed the evaporation performance of outdoor heat exchanger 5.

In order to perform heating, it is necessary to allow the refrigerant to flow through indoor heat exchanger 51 for heat exchange between the refrigerant and the air. In addition, in order to discharge the liquid refrigerant in accumulator 6 in an early stage, it is better to close on-off valve 31 than to open on-off valve 31. Therefore, it is better to close on-off valve 31 in order to enhance the reliability. However, with on-off valve 31 closed, the refrigerant does not flow through indoor heat exchanger 51. Therefore, after the liquid refrigerant in accumulator 6 is discharged with on-off valve 31 closed and the reliability is ensured, on-off valve 31 is preferably opened. As a result, ensuring of the reliability and provision of the heating capacity in an early stage can be both achieved.

According to refrigeration cycle apparatus 100 in the present embodiment, electric pump 21 is driven in a state where on-off valve 31 closes first refrigerant route 10 at startup of compressor 1, and after the refrigerant is flown from accumulator 6 to liquid-side connection pipe 4 by electric pump 21, on-off valve 31 opens first refrigerant route 10. Therefore, ensuring of the reliability and provision of the heating capacity in an early stage can be both achieved.

In addition, by closing on-off valve 31, the liquid refrigerant is accumulated not only in indoor heat exchanger 51 but also in liquid-side connection pipe 4 from indoor heat exchanger 51 to on-off valve 31. Therefore, provision of the heating capacity can be made much earlier.

Third Embodiment

Figure 8:
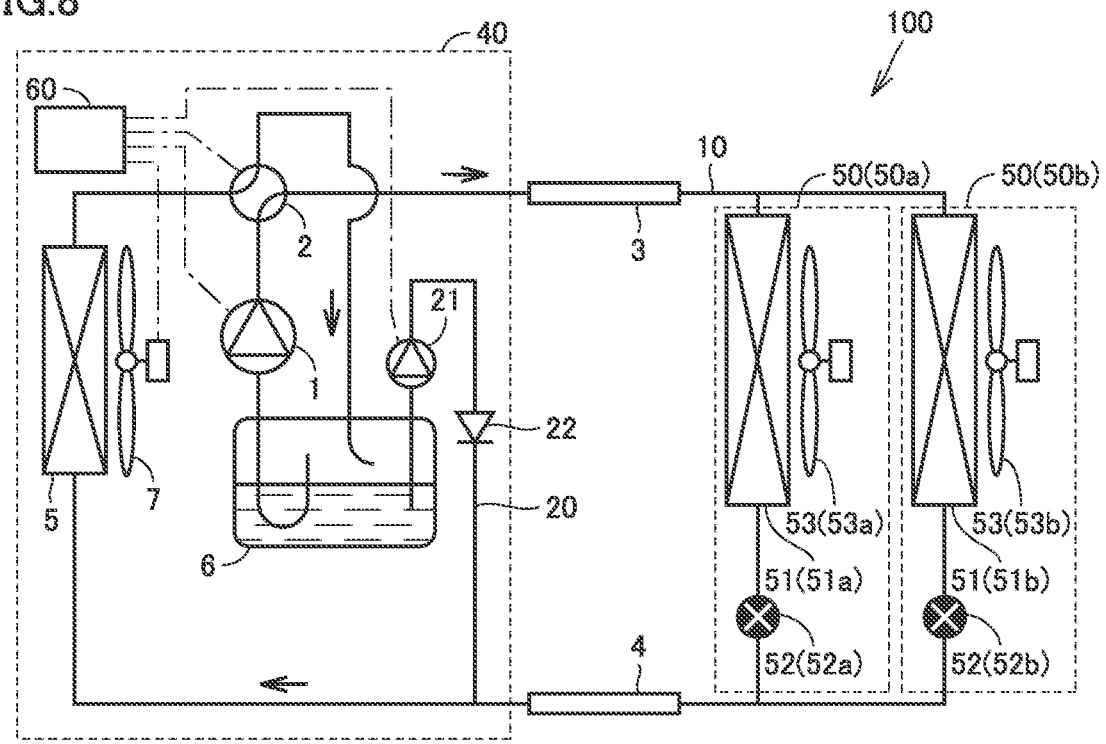
FIG. 8 is a refrigerant circuit diagram showing a state in which a decompressing apparatus in a refrigeration cycle apparatus according to a third embodiment of the present invention is closed.

Refrigeration cycle apparatus 100 according to a third embodiment of the present invention will be described with reference to FIG. 8. Refrigeration cycle apparatus 100 according to the present embodiment is configured similarly to above-described refrigeration cycle apparatus 100 according to the first embodiment. In above-described refrigeration cycle apparatus 100 according to the second embodiment, on-off valve 31 is provided in first refrigerant route 10. However, even if on-off valve 31 is not provided in first refrigerant route 10, an effect similar to that of above-described refrigeration cycle apparatus 100 according to the second embodiment can be produced simply by opening and closing of first refrigerant route 10 by decompressing apparatuses 52*a* and 52*b*. In FIG. 8, decompressing apparatuses 52*a* and 52*b* are filled in a black color in order to show a state in which decompressing apparatuses 52*a* and 52*b* are closed.

In refrigeration cycle apparatus 100 in the present embodiment, first refrigerant route 10 includes decompressing apparatuses 52*a* and 52*b*. Decompressing apparatuses 52*a* and 52*b* are configured to open and close first refrigerant route 10 between indoor heat exchanger 51 and outdoor heat exchanger 5 in first refrigerant route 10.

Referring to FIG. 8, in refrigeration cycle apparatus 100, electric pump 21 is driven in a state where decompressing apparatuses 52*a* and 52*b* close first refrigerant route 10 at startup of compressor 1. After the refrigerant is flown from accumulator 6 to liquid-side connection pipe 4 by electric pump 21, decompressing apparatuses 52*a* and 52*b* open first refrigerant route 10.

When decompressing apparatuses 52*a* and 52*b* are closed and electric pump 21 is operated at the start of the heating operation, accumulation of the liquid refrigerant in indoor heat exchangers 51*a* and 51*b* and discharge of the liquid refrigerant in accumulator 6 can be promoted. Therefore, provision of the heating capacity can be made much earlier.

According to refrigeration cycle apparatus 100 in the present embodiment, electric pump 21 is driven in a state where decompressing apparatuses 52*a* and 52*b* close first refrigerant route 10 at startup of compressor 1, and after the refrigerant is flown from accumulator 6 to liquid-side connection pipe 4 by electric pump 21, decompressing apparatuses 52*a* and 52*b* open first refrigerant route 10. Therefore, ensuring of the reliability and provision of the heating capacity in an early stage can be both achieved.

Fourth Embodiment

Figure 9:
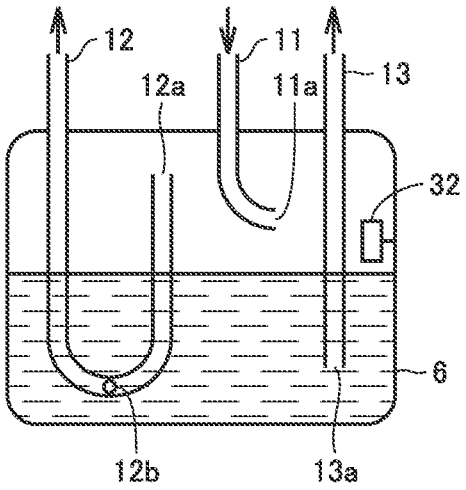
FIG. 9 is a schematic cross-sectional view of an accumulator according to a fourth embodiment of the present invention.

Referring to FIG. 9, refrigeration cycle apparatus 100 according to a fourth embodiment of the present invention is different from refrigeration cycle apparatus 100 according to the first embodiment of the present invention in that refrigeration cycle apparatus 100 according to the fourth embodiment of the present invention includes a liquid level sensor 32.

Refrigeration cycle apparatus 100 in the present embodiment includes liquid level sensor 32. Liquid level sensor 32 is configured to detect the liquid level of the refrigerant in accumulator 6. Liquid level sensor 32 is provided in accumulator 6. Liquid level sensor 32 is electrically connected to controller 60.

Liquid level sensor 32 is, for example, a liquid level detector. A type of the liquid level detector may be, for example, a capacitance type, a heater type or a float type. In the case of the capacitance type, a difference in dielectric constant between a liquid and a vapor between electrodes is detected. In the case of the heater type, a difference in amount of heat dissipation between a liquid and a vapor is detected. In the case of the float type, a position of a float is detected.

Figure 10:
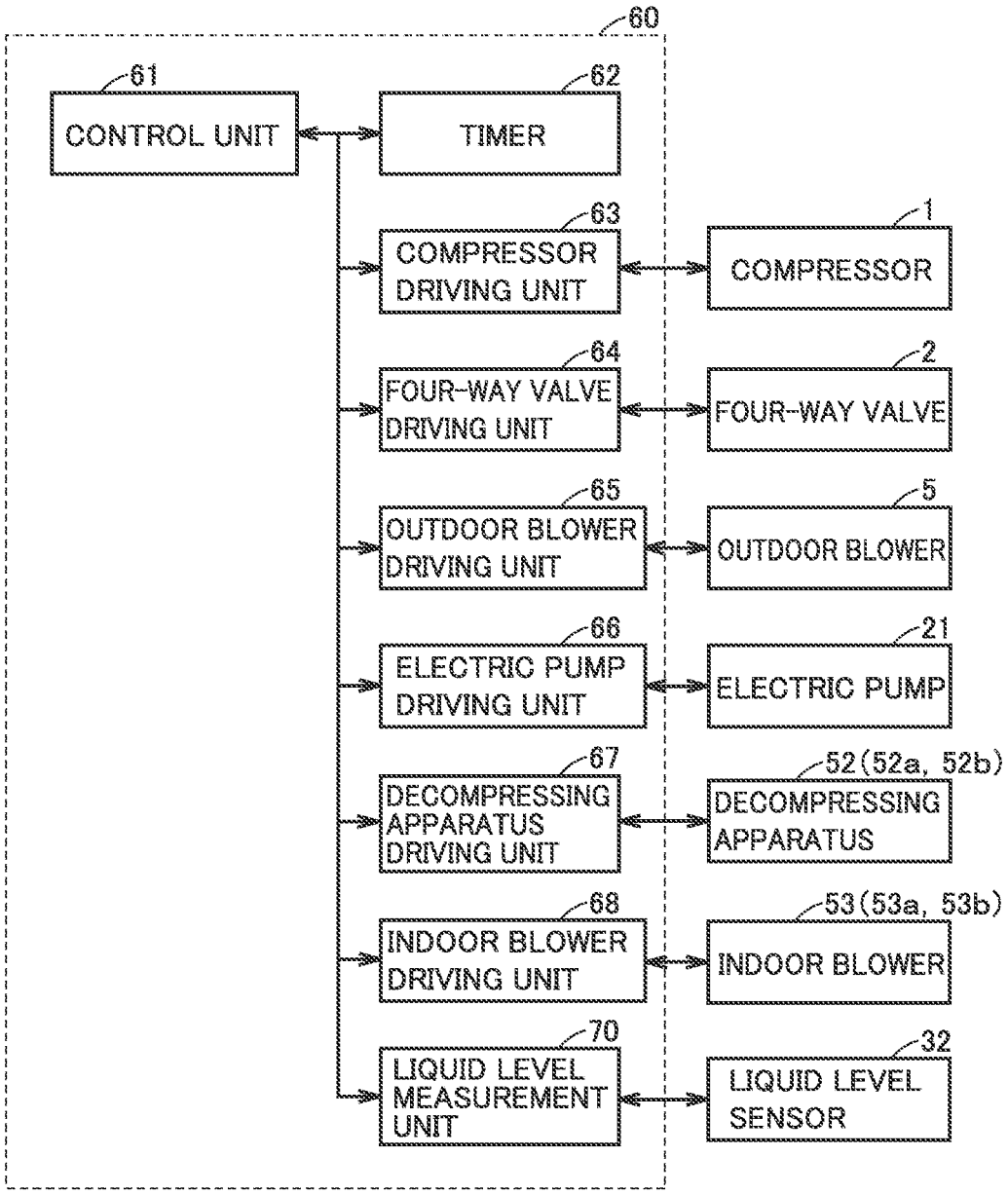
FIG. 10 is a functional block diagram of a refrigeration cycle apparatus according to the fourth embodiment of the present invention.

Referring to FIG. 10, in the present embodiment, controller 60 includes a liquid level measurement unit 70. Liquid level measurement unit 70 measures a height of the liquid level of the refrigerant based on a signal from liquid level sensor 32, and transmits a signal based on the liquid level to control unit 61.

Figure 11:
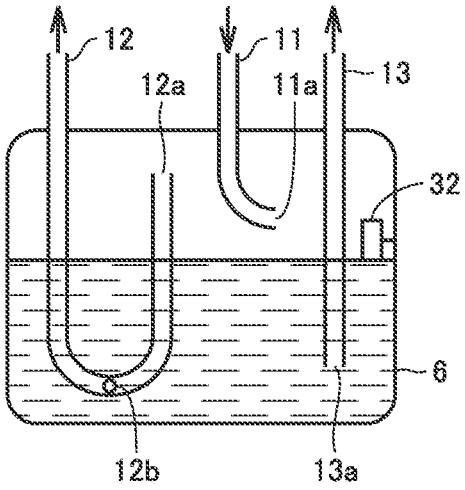
FIG. 11 is a schematic cross-sectional view showing a state in which liquid refrigerant is in contact with a liquid level sensor in the accumulator according to the fourth embodiment of the present invention.

Referring to FIG. 11, liquid level sensor 32 is arranged below flow outlet 12*a* of outflow pipe 12. That is, liquid level sensor 32 is located vertically below flow outlet 12*a*. Electric pump 21 is driven when liquid level sensor 32 detects the liquid level of the refrigerant below flow outlet 12*a*. Electric pump 21 is driven while liquid level sensor 32 is detecting the liquid level of the refrigerant. Electric pump 21 is stopped when liquid level sensor 32 no longer detects the liquid level of the refrigerant.

If the liquid level of the refrigerant is located above flow outlet 12*a* of outflow pipe 12, compressor 1 suctions the liquid refrigerant flowing out through flow outlet 12*a*, and thus, compressor 1 fails. Therefore, it is necessary to detect a rise in liquid level before the liquid level of the refrigerant rises and arrives at flow outlet 12*a*. Since liquid level sensor 32 is provided vertically below flow outlet 12*a*, liquid level sensor 32 can detect a rise in liquid level before the liquid level of the refrigerant rises and arrives at flow outlet 12*a*. Since electric pump 21 is driven while liquid level sensor 32 is detecting the liquid level of the refrigerant, a rise in liquid level of the refrigerant and arrival of the liquid level of the refrigerant at flow outlet 12*a* can be suppressed.

When the liquid level of the refrigerant in accumulator 6 reaches a height equal to or higher than a certain height before arriving at flow outlet 12*a*, liquid level sensor 32 detects the liquid level of the refrigerant. Controller 60 drives electric pump 21 based on a signal about detection of the liquid level of the refrigerant from liquid level sensor 32. When electric pump 21 is operated, the refrigerant in accumulator 6 is discharged. Electric pump 21 is driven until liquid level sensor 32 no longer detects the liquid level of the refrigerant. This can reduce or prevent a phenomenon in which the liquid level in accumulator 6 goes beyond flow outlet 12*a* of outflow pipe 12 and compressor 1 suctions the liquid refrigerant. Therefore, a failure of compressor 1 caused by suction of the liquid refrigerant into compressor 1 can be suppressed. Furthermore, electric pump 21 is stopped when liquid level sensor 32 no longer detects the liquid level of the refrigerant.

In refrigeration cycle apparatus 100 in the present embodiment, electric pump 21 is driven when liquid level sensor 32 detects the liquid level of the refrigerant below flow outlet 12*a*. Therefore, since electric pump 21 is driven when liquid level sensor 32 directly detects a rise in liquid level of the refrigerant in accumulator 6, the reliability of discharge of the liquid refrigerant is enhanced.

In refrigeration cycle apparatus 100 in the present embodiment, electric pump 21 is driven while liquid level sensor 32 is detecting the liquid level of the refrigerant, and electric pump 21 is stopped when liquid level sensor 32 no longer detects the liquid level of the refrigerant. Therefore, arrival of the liquid level of the refrigerant at flow outlet 12*a* can be suppressed. In addition, since electric pump 21 is stopped after the refrigerant in accumulator 6 is discharged, an increase in motive power of electric pump 21 can be suppressed.

Fifth Embodiment

Figure 12:
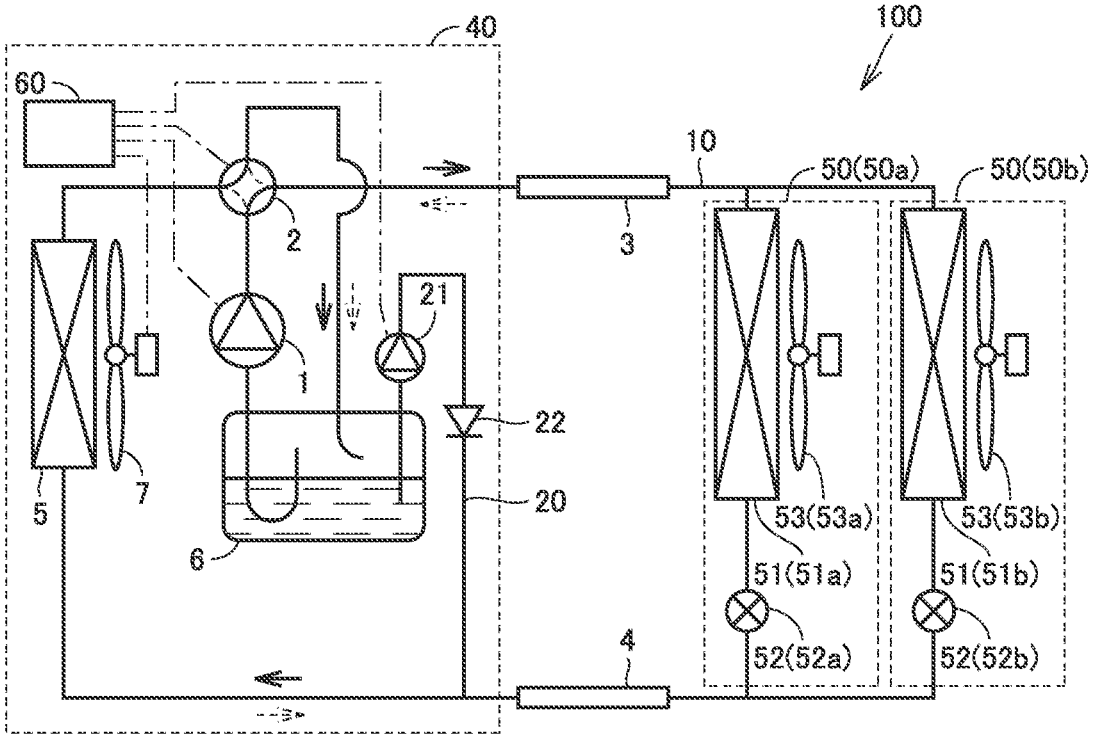
FIG. 12 is a refrigerant circuit diagram during a heating operation and during a cooling operation in a refrigeration cycle apparatus according to a fifth embodiment of the present invention.

Referring to FIG. 12, refrigeration cycle apparatus 100 according to a fifth embodiment of the present invention includes a refrigerant circuit similar to that of above-described refrigeration cycle apparatus 100 according to the first embodiment. In FIG. 12, a flow of the refrigerant during the heating operation is indicated by a solid arrow, and a flow of the refrigerant during the cooling operation is indicated by a dashed arrow.

In either case of the heating operation and the cooling operation, electric pump 21 may be constantly operated during operation of compressor 1, regardless of the time that elapses from the start of operation. In refrigeration cycle apparatus 100 in the present embodiment, electric pump 21 is constantly driven while compressor 1 is being driven. A certain amount of the liquid refrigerant constantly flows out of accumulator 6 through liquid draining pipe 13, and thus, the operation of refrigeration cycle apparatus 100 is stabilized in a state where a corresponding amount of the liquid refrigerant is introduced from inflow pipe 11.

Generally, the heat transfer performance of an evaporator is better when the refrigerant flowing through the evaporator is in a gas-liquid two-phase state than when the refrigerant flowing through the evaporator is in a vapor single-phase state. Generally, the refrigerant at an outlet of the evaporator is controlled to be in a vapor single-phase state, in order to prevent an overflow of the liquid refrigerant in accumulator 6 and suction of the liquid refrigerant into compressor 1. In the present embodiment, by constantly operating electric pump 21, the state of the refrigerant in the evaporator can be controlled to a gas-liquid two-phase state in the entire evaporator. As a result, the performance of the evaporator is enhanced, and thus, the highly-efficient operation becomes possible.

In refrigeration cycle apparatus 100 in the present embodiment, electric pump 21 is constantly driven while compressor 1 is being driven, and thus, the operation of refrigeration cycle apparatus 100 is stabilized. In addition, the performance of the evaporator is enhanced, and thus, the highly-efficient operation becomes possible.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

The invention claimed is:

1. A refrigeration cycle apparatus comprising:

a first refrigerant route in which refrigerant flows in order of a compressor, a first heat exchanger, a first pipe, a second heat exchanger, a low pressure receiver and the compressor; and a second refrigerant route connected to the first pipe and the low pressure receiver, the first pipe being connected to the first heat exchanger and the second heat exchanger in the first refrigerant route, the second refrigerant route including an electric pump, the electric pump being configured to flow the refrigerant from the low pressure receiver to the first pipe, the first refrigerant route comprising a decompressing control valve configured to open and close the first refrigerant route between the first heat exchanger and the second heat exchanger in the first refrigerant route, wherein at startup of the compressor, the decompressing control valve closes the first refrigerant route and the electric pump flows the refrigerant from the low pressure receiver to the first pipe, after the electric pump flows the refrigerant from the low pressure receiver to the first pipe, the decompressing control valve opens the first refrigerant route, the refrigeration cycle apparatus further comprises a liquid level sensor configured to detect a liquid level of the refrigerant in the low pressure receiver, the first refrigerant route comprises a first refrigerant route flow outlet located in the low pressure receiver and configured to allow the refrigerant to flow out of the low pressure receiver to the compressor, the liquid level sensor is arranged below the first refrigerant route flow outlet, and the electric pump flows the refrigerant from the low pressure receiver to the first pipe when the liquid level sensor detects the liquid level of the refrigerant is below the first refrigerant route flow outlet.

2. The refrigeration cycle apparatus according to claim 1, wherein the first refrigerant route comprises an oil return hole located in the low pressure receiver and configured to return a lubricating oil of the compressor from the low pressure receiver to the compressor, the second refrigerant route comprises a second refrigerant route flow outlet located in the low pressure receiver and configured to allow the refrigerant to flow out of the low pressure receiver to the first pipe, and the second refrigerant route flow outlet is arranged above the oil return hole.

3. The refrigeration cycle apparatus according to claim 1, wherein the electric pump flows the refrigerant from the low pressure receiver to the first pipe while the liquid level sensor is detecting the liquid level of the refrigerant, and the electric pump stops the flow of the refrigerant from the low pressure receiver to the first pipe when the liquid level sensor no longer detects the liquid level of the refrigerant.

4. A refrigeration cycle apparatus comprising:

a first refrigerant route in which refrigerant flows in order of a compressor, a first heat exchanger, a first pipe, a second heat exchanger, a low pressure receiver and the compressor; and a second refrigerant route connected to the first pipe and the low pressure receiver, the first pipe being connected to the first heat exchanger and the second heat exchanger in the first refrigerant route, the second refrigerant route including an electric pump, the electric pump being configured to flow the refrigerant from the low pressure receiver to the first pipe, the first refrigerant route comprising a decompressing control valve configured to open and close the first refrigerant route between the first heat exchanger and the second heat exchanger in the first refrigerant route, wherein at startup of the compressor, the decompressing control valve closes the first refrigerant route and the electric pump flows the refrigerant from the low pressure receiver to the first pipe, after the electric pump flows the refrigerant from the low pressure receiver to the first pipe, the decompressing control valve opens the first refrigerant route, the first refrigerant route comprises an on-off valve configured to open and close the first refrigerant route between the first heat exchanger and the second heat exchanger in the first refrigerant route, the second refrigerant route is connected to the first pipe between the on-off valve and the second heat exchanger, the electric pump is flows the refrigerant from the low pressure receiver to the first pipe in a state where the on-off valve closes the first refrigerant route at startup of the compressor, and after the refrigerant flows from the low pressure receiver to the first pipe, the on-off valve opens the first refrigerant route.

5. The refrigeration cycle apparatus according to claim 1, wherein the electric pump flows the refrigerant from the low pressure receiver to the first pipe at startup of the compressor, and after the refrigerant flows from the low pressure receiver to the first pipe, the electric pump stops the flow of refrigerant.

6. The refrigeration cycle apparatus according to claim 1, wherein the electric pump flows the refrigerant from the low pressure receiver to the first pipe when a heating operation starts after a defrosting operation ends, the heating operation being an operation during which the refrigerant flows from the compressor to the first heat exchanger, the defrosting operation being an operation during which the refrigerant flows from the compressor to the second heat exchanger.

7. The refrigeration cycle apparatus according to claim 1, wherein while the compressor is operating, the electric pump constantly flows the refrigerant from the low pressure receiver to the first pipe.

* * * * *